United States Patent [19]

Sieverin

[11] Patent Number: 4,951,726

[45] Date of Patent: Aug. 28, 1990

[54] POWERED LOGSPLITTER

[76] Inventor: Walter J. Sieverin, 1310 Appaloosa Trail, McHenry, Ill. 60050

[21] Appl. No.: 477,515

[22] Filed: Feb. 9, 1990

[51] Int. Cl.[5] ..... B27L 7/00

[52] U.S. Cl. ..... 144/366; 144/193 A

[58] Field of Search ..... 144/3 K, 193 R, 193 A, 144/366

[56] References Cited

U.S. PATENT DOCUMENTS

| | | | |
|---|---|---|---|
| 3,077,214 | 2/1963 | Brunker | 144/193 A |
| 3,342,955 | 3/1966 | Hellstrom | 144/193 A |
| 3,974,867 | 8/1976 | Butas, Jr. | 144/193 A |
| 4,076,062 | 2/1978 | Kanik | 144/193 A |
| 4,153,088 | 5/1979 | King et al. | 144/193 A |
| 4,252,165 | 2/1981 | Hansen | 144/193 A |
| 4,273,171 | 6/1981 | Spaulding, Sr. | 144/3 K |
| 4,284,113 | 8/1981 | Nordlin | 144/193 A |
| 4,641,694 | 2/1987 | Rhode | 144/3 K |

*Primary Examiner*—W. Donald Bray

*Attorney, Agent, or Firm*—Mathew R. P. Perrone, Jr.

[57] ABSTRACT

A power device for splitting a log into four pieces avoids the problems of sticking the log on the wedge by positioning the splitting assembly to permit the split portions of the log to separate as vertical is started prior to horizontal splitting.

20 Claims, 4 Drawing Sheets

FIG. 1
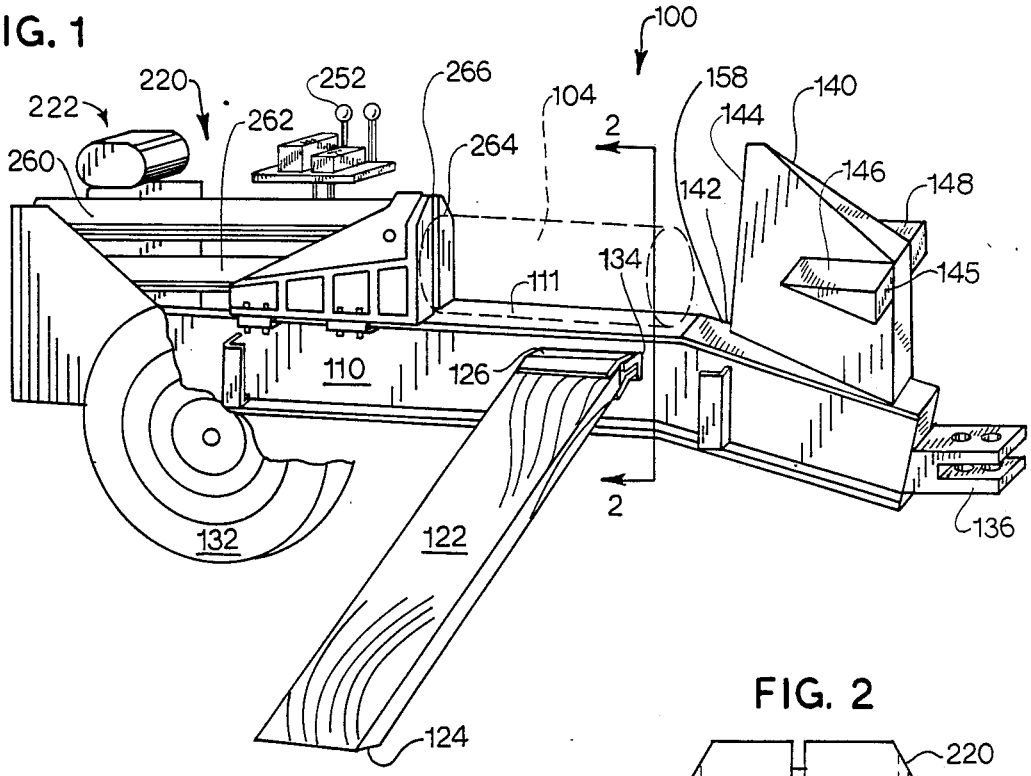
FIG. 2
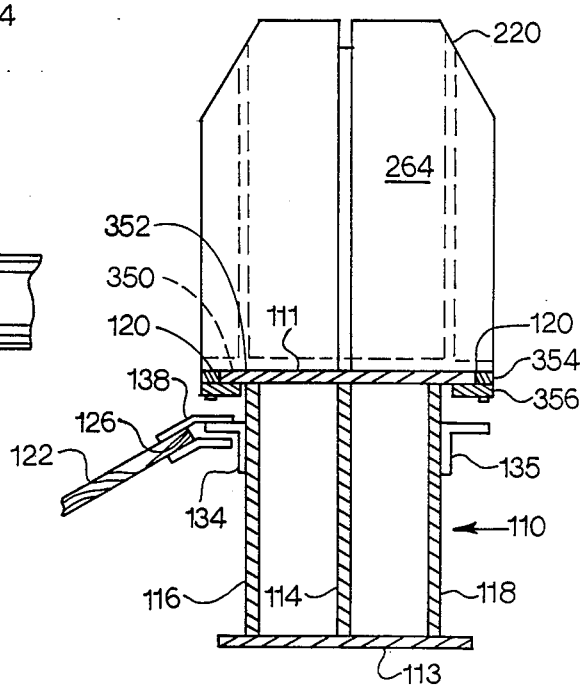
FIG. 6
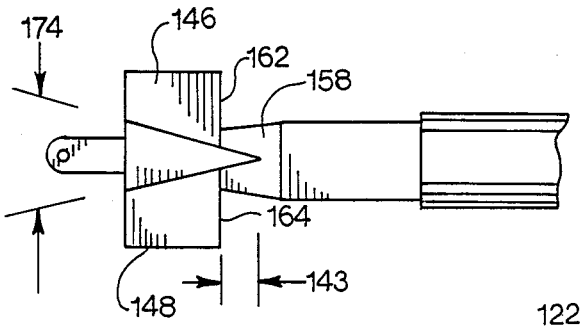
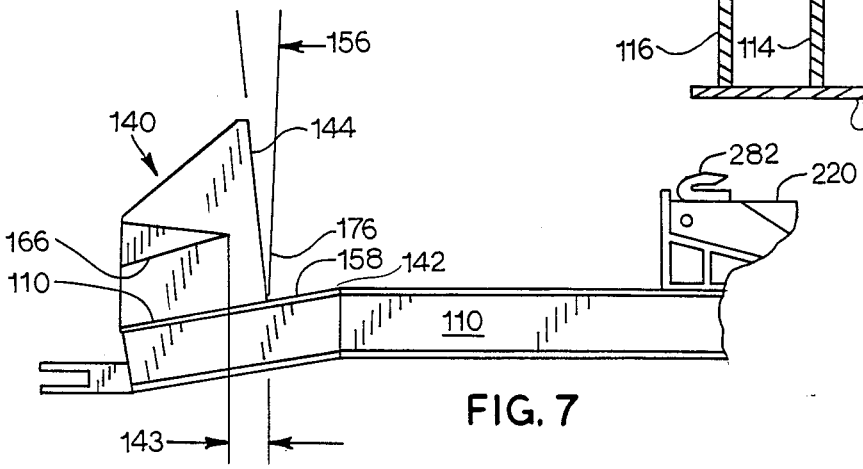
FIG. 7

FIG. 3
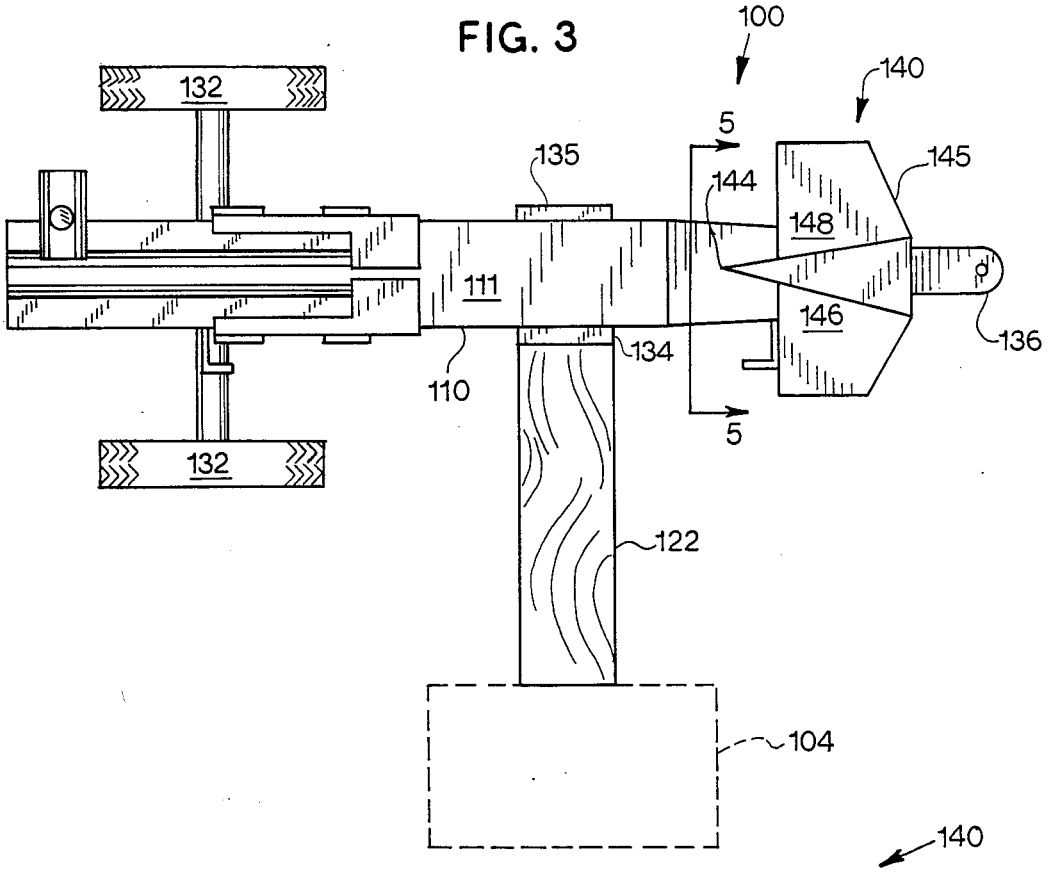
FIG. 4
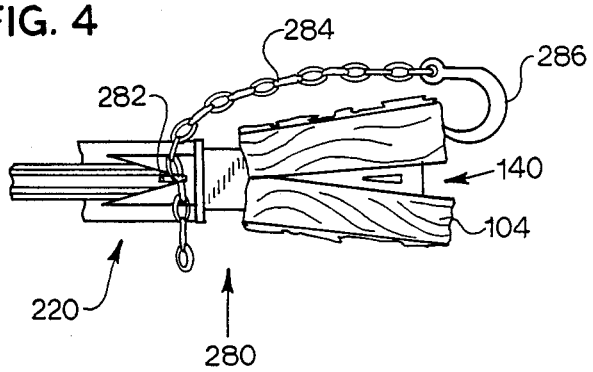
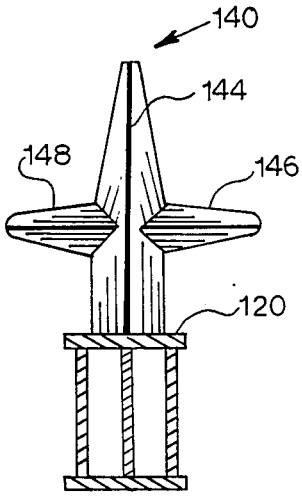
FIG. 5

POWERED LOGSPLITTER

This invention relates to a power device for splitting logs and more particularly to a powered device for splitting a log into four pieces.

BACKGROUND OF THE INVENTION

There are many critical areas that are well known as the cause of problems in the art of log splitting. These problems are associated with both hand tools, and powered devices—such as the screw type and powered wedge type, which are the more predominant log splitters on the market.

It is well known that hand splitting of logs is a difficult, physical task. Many devices are known to avoid the problems of the hand splitting difficulties. Those devices are known to be powered for the purpose of splitting logs. However, these devices suffer from innumerable problems. One problem from the current power devices is the fact that the log being split can become stuck on the wedge. When the log is stuck on the wedge, a substantial amount of hand work can be required to loosen the log.

One of the other typical problems of splitting the log is the presence of a knot in the log. The knots in the log are cross-grained, hard elements, which can jam the log splitting device and require a substantial amount of hand work with a hand wedge and mall—in an attempt to assist the log splitter with either the continuation splitting action, or the more difficult task of trying to remove the stuck log from the log splitter.

Also some of the prior art devices have semi-circular bases which cause excess log splitting forces when logs wedge against the semi-circular log holder. The prior art devices teach that the holding mechanism must position the log properly. The design of these holding mechanisms limit the size of the logs to be split. These devices are appropriate for positioning but not for splitting. During the splitting operation, the holding mechanism causes excessive forces on the powered machinery and does not achieve the desired results—including a clean, complete split of the log.

Additionally, a requirement of the powered log splitter of the prior art is that the ram does not meet the wedge—since if the ram did hit the wedge, the wedge edge would be damaged. Thus the log is not totally split by the power splitters of the prior art, and the strings or last knotty items of the log may not be split.

Additionally, a powered log splitting device must be designed to avoid the log getting stuck on the multi-wedge designs. Short wedge lengths avoid the structural requirements but leave the upper portion of larger logs unsplit, and require hand assistance to complete the split. Another problem is with the loading of larger logs onto the splitter. With these many problems, it is difficult to provide a powered log splitter which handles these situations.

It is also important that a log splitting device be flexible, while minimizing log splitting time by having a multi-wedge design, a fast cycle time and a capability of taking logs of many different diameters with knots and provide the excess force required to split the difficult logs without penalizing the cycle time for the majority of the smaller logs. The limitations on the size of the log being split should be minimized.

Hand loading of a log onto a log splitter can be a difficult task for larger log. It is desirable to have some assistance with this loading of the log into the log splitter. Also, this loading mechanism must avoid any interference with the splitting mechanism while the log is being split. But the built in cranes, hydraulic power lifts or other such devices, are cumbersome, costly, slow and time consuming to use.

SUMMARY OF THE INVENTION

Accordingly, among the many objects of this invention is to provide an improved powered device to split a log.

A further objective of this invention is to provide a powered device to split a log into four (4) pieces.

A still further objective of this invention is to provide a powered device to minimize the sticking of the log between the underside of the horizontal wedge and the device frame.

Yet a further objective is to provide a simplified electrical-mechanical engine speed control that increase the engine speed during the log splitting cycle and retract cycle while allowing the engine to idle when the manual valve is in the neutral position.

Also an objective of this invention is to provide a unique design that allows the ram to extend beyond the vertical wedge to completely split the remaining stringers or knots.

Another objective of this invention is to provide a powered device to split a log having a simplified apparatus for releasing a log stuck on the splitter.

Still another objective of this invention is to provide a powered device to split a log having a simplified loading capability which can be left in position while splitting the loaded log.

Yet another objective of this invention is to provide a powered device to split a log which has an increased force capability on demand while having a significant decrease in cycle time when unloaded and for splitting smaller logs which are the predominant log sizes being split.

These and other objectives of this invention are met by providing a powered device for splitting a log into four (4) pieces, including a loading ramp for loading the log on the splitter, a dual cylinder ram for obtaining a significant increase in speed while having the force capability for large knotty logs, and a powered chain hook log release for releasing a log jammed on the wedge assembly.

BRIEF DESCRIPTION OF THE DRAWINGS

FIG. 1 illustrates a perspective view of the log splitter 100 of the invention.

FIG. 2 illustrates a cross-section of FIG. 1 along Line 2—2 to show the mounting of loading ramp 122 and the face of the ram assembly 220.

FIG. 3 illustrates a top view of FIG. 1.

FIG. 4 illustrates the feature of log release assembly 280 with a log hook 286 with chain 284 attached to the ram assembly 220 for a method of using the ram assembly 220 through chain hook 282 to remove a partially split knotty log 104 that is stuck on the four way splitting assembly 140 due to an inadequate ram force to complete the splitting cycle.

FIG. 5 illustrates a frontal view of the four (4) way splitting assembly 140 from the ram assembly 220.

FIG. 6 illustrates a top view of the four (4) way splitting assembly 140.

FIG. 7 illustrates a side view of the four (4) way splitting assembly 140.

Throughout the Figures of the drawing, where the same part appears in more than one Figure of the drawing, the same number is applied thereto.

DESCRIPTION OF THE PREFERRED EMBODIMENTS

Figure 8:
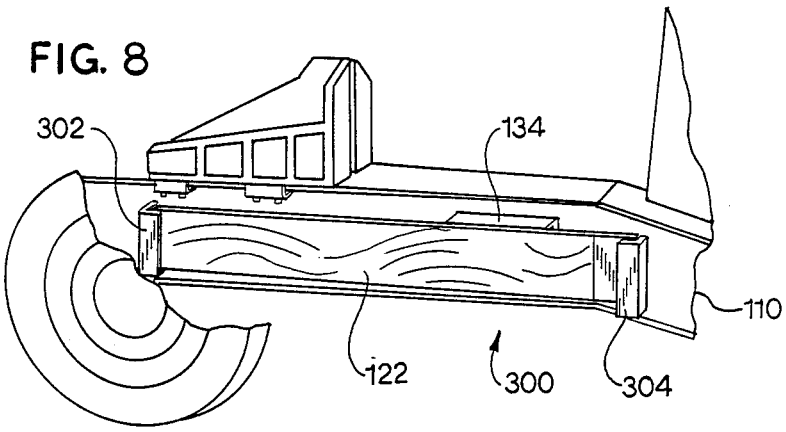
FIG. 8 illustrates a side view of the loading plank 122 in the stored position.

There are many critical areas that are well known in the art of log splitting associated with hand tools, and powered devices such as screws and powered wedge type which are the more predominant log splitters on the market.

This disclosure describes the features of an enhanced system which splits a log into four (4) pieces with a single pass of the powered ram. This disclosure also contains a novel electrical-mechanical solenoid actuated system which is coupled to a manually operated four (4) way cylinder valve. The manual valve has three (3) operating positions; forward which moves the cylinder ram forward, neutral (center position) and reverse which retracts the cylinder ram.

When the manual valve is actuated to the forward position (with the ram extended), the solenoid system, as operated by switches, actuates the gas engine throttle valve to the operating speed. When the manual valve is in the neutral position, the gas engine is set to the idle speed by the linkage system. When the manual valve is actuated to the reverse condition (ram being retracted), the gas engine throttle valve is actuated to the higher engine revolution per minute operating speed. Whenever the manual valve is released, it returns to the center or neutral position which, through the de-energized solenoid system, allows the gas engine speed to return to the idle condition automatically.

By using the four (4) way splitting wedge along with the gas engine throttle linkage control system, up to eighty (80%) percent savings in splitting time can be obtained and up to a fifty (50%) percent fuel savings can be obtained as well as a significant reduction in air pollution.

The loading plank may be fixed to either side of the log splitter for use in loading of the logs. It may also be stored on one side or the other of the log splitter if proper holding brackets are present. With the plank in the loading position, there is no interference with the log splitting action.

A dual cylinder action can handle the larger logs. The smaller cylinder can handle the routine logs and provide the fast cycle time. The larger cylinder can provide the excess force required to handle the larger logs or those full of knots. The clearance angles also provide for this splitting factor.

The ram of this device is slotted so that it can receive and overlap the vertical wedge. In this fashion, the log is split completely by the log splitter without any stringers.

The horizontal wedge is set back from the vertical wedge to allow the vertical wedge to split the log first before the horizontal wedge starts splitting the log. This avoids the high force requirement if both the horizontal wedge and vertical wedge were to engage the log and try to split it at the same time. The log splitters of the prior art have the ram stop short of the vertical wedge. If stringers or remaining knots are not split, further splitting (usually hand assisted or axe assisted) is required to finish the cycle. This of course wastes log splitting time, and is not required for the log splitter of this invention, because the ram is slotted and overlaps the vertical wedge.

The vertical wedge is set back a distance from the start of the beam downward angle to allow excess clearance for any log shape entering the vertical wedge without interference from the main beam. The dimension between the start of the horizontal wedge and the face is much smaller than the dimension between the base and the exit of the horizontal wedge. This structure allows additional horizontal wedge clearance for logs being split.

The vertical dimension between the underside of the leading edge of the horizontal wedge, and the angle portion of the beam increases as the log being split progresses along the log splitter. The splitting thus occurs without the log wedging and sticking on the log splitter. The beam at the wedge end has an angle which is larger than the angle of the horizontal wedge and creates an increasing dimension toward log exit end of the log splitter.

THE LOG SPLITTER

Referring now to FIG. 1, the log splitter 100 is shown in operating position having loading plank 122 in position to receive log 104. Frame 110 receives the loading plank 122. The frame 110 has a ram assembly 220 at one end thereof and a wedge splitting assembly 140 at an opposing end thereof. Between the ram assembly 220 and the splitting assembly 140 is the log receiving platform 111 for a log 104. Ram assembly 220 pushes log 104 onto splitting assembly 140 and splits the log 104 into four (4) pieces.

Loading plank 122 has an optional beveled end 124 to contact the ground, so that log 104 is smoothly movable up loading plank 122, and a latch end 126, oppositely disposed from beveled end 124 and in contact with the frame 110. Log receiving platform 111 has loading mount 134 secured adjacent thereto to receive plank 122, so that a log 104 can be rolled up plank 122 onto platform 111 for splitting.

When considering FIG. 1 and FIG. 2 together, frame 110 of log splitter 100 has a standard I-beam cross section to which two side plates are welded or otherwise secured to provide a box shape for strength. The I-beam of frame 110, of course, has a flat top side of the I-beam to form the log receiving platform 111 and a flat base 113 oppositely disposed therefrom.

Within the I-beam of frame 110, are the two side plates as a first steel plate 116 and a second steel plate 118. The first steel plate 116 is welded or otherwise secured on one side of the central portion 114 of I-beam of frame 110 and parallel thereto. The second steel plate 118 is welded on the opposing side of the central portion 114 of the I-beam of frame 110 inside the top of log receiving platform 111 at the I-beam of frame 110. In this fashion, a ledge 120 is formed on either side of the frame 110 to receive the ram assembly 220.

RAM STRUCTURE

Referring to FIG. 1, the ram assembly 220 includes a first lower ram cylinder 262 for the smaller logs and a second upper ram cylinder 260 which may be used in conjunction with first lower ram cylinder 262 to achieve the necessary power for the larger logs. Frame 110 is supported by a pair of tires 132 mounted in a standard fashion, which provide a manner of towing or otherwise moving the log splitter 100.

In FIG. 2, loading mount includes a first angle bar mount 134 on first plate 116 and a second angle bar mount 135 on second plate 118 to receive latch end 126 of plank 122 which sits therein. FIG. 1 shows splitting assembly 140 as including a splitting base 142 having a vertical wedge 144 and a horizontal wedge assembly 145.

RAM FACE STRUCTURE

Referring now to FIG. 2, a front view of ram face 264 is depicted. The ram mounting assembly 350 is also depicted. Ram mounting assembly 350 includes a base plate 352 for sliding on frame 110 and, in particularly on the surface of log receiving platform 111 of the I-beam. Adjacent to the ram base plate 352 on either side thereof is a spacer plate 354. Bolted through the spacer plate 354 and ram base plate 352 is the gripping plate 356, which protrudes from the spacer plate 354 in an L-shaped fashion under the frame 110 at the ledge 120 formed in the frame 110. In this fashion, the ram face 264 is strongly positioned on the ram frame 110. This is a feature that provides for a very strong ram assembly 352.

Referring now to FIG. 3, a top view of the log splitter 100 is shown. In this fashion, both of tires 132 may be shown along with the additional structure of the splitting assembly 140. The horizontal wedge assembly 145 is depicted as having a first horizontal wedge 146 and a second horizontal wedge 148.

It is the appropriate angles between the log receiving platform 111 of frame 110 and the splitting assembly 140, that permit the highly efficient splitting assembly. Additionally from this top view, the trailer hitch 136 is depicted. With the trailer hitch 136, the splitting assembly 100 can be towed to any suitable site for use.

LOG RELEASE ASSEMBLY

Referring now to FIG. 4, there is a log release assembly 280 which solves a major problem in power log splitting. The log 104 being split can become stuck on the wedge of the power splitter. It is desired to release this stuck log without a substantial amount of hand work. The log release assembly 280 accomplishes this aspect of it in the unlikely event a log is stuck on log splitter 100. Basically, on the ram assembly 220 is mounted a chain receiving hook 282. The chain receiving hook 282 can receive a logging chain 284. Logging chain 284 has secured at the other end of chain 284, a log hook 286. The other end of chain 284 is hooked into chain receiving hook 282.

As the ram assembly 220 is retracted, the chain 284 tightens, and the log hook 286 pulls the log 104 away from the splitting assembly 140. In this fashion, a substantial amount of hand work for removing a stuck log 104 from the splitting assembly 140 is avoided.

SPLITTING ASSEMBLY

Referring now to FIG. 5, splitting assembly 140 is shown from a front view thereof such that it is the view seen by the log 104 (shown in FIG. 1) as the log 104 is moved toward the splitting assembly 140. This view is accomplished by taking a section of frame 110 along Line 5—5 of FIG. 3. As can be seen from FIG. 1 and FIG. 7, frame 110, which includes log receiving platform 111 is sloped for receiving log 104 up loading plank 122.

By considering FIG. 5, FIG. 6 and FIG. 7, the angle between log receiving platform 111 and splitting assembly 140 is lower beam angle 158. The lower beam angle 158 is greater than lower horizontal wedge angle 166 of horizontal wedge assembly 145. Lower beam angle 158 is preferably in the range of five (5°) to twenty-five (25°) degrees. Most preferably, lower beam angle 158 is fifteen (15°) to twenty (20°) degrees. The angle size difference with lower beam angle 158 is greater than lower horizontal wedge angle 166, which provides space for a split log 104 to avoid jamming of the log splitter 100.

Lower horizontal wedge angle 166 is the angle of horizontal wedge assembly 145 which is basically one-half of the vertex angle of horizontal wedge assembly 145. Lower horizontal wedge angle 166 is always at least five (5°) degrees less than lower beam angle 158. More preferably, lower horizontal wedge angle 166 is always at least seven (7°) degrees less than lower beam angle 158.

In FIG. 7, the splitting assembly 140 that first contacts the log 104 is vertical wedge 144. As the log 104 proceeds along vertical wedge 144, it is partially split in two, and then the two parts make contact with the horizontal wedge assembly 145. It is clear from the structure shown in FIG. 6 that first horizontal wedge 146 and second horizontal wedge 148 are also contacted at substantially the same time.

In this fashion, lower horizontal wedge angle 166 combined with the value of lower beam angle 158, achieves a substantial advantage in splitting of a log 104. It can be seen from further discussion, that various angles of the wedges of the vertical wedge 144 and the horizontal wedges 146 and 148, that the efficiency of the log splitter 100 is greatly enhanced.

In FIG. 7, vertical wedge angle 156 is the angle of the log receiver platform 111 with respect to the vertical wedge 144, vertical wedge angle 156 provides the initial contact at the lower portion of log 104 as the log 104 is pushed by ram assembly 220 towards the edge of vertical wedge 144. As the ram assembly 220 forces an edge of the log 104 into the vertical wedge 144, it is first split in half, a distance 143 before reaching the horizontal wedges 146 and 148 in FIG. 6. Distance 143 is up to about twelve (12) centimeters (4.8 inches). Most preferably, distance 143 is up to about nine (9) centimeters (3.54 inches). Except for very knotty or stringy fiber wood, the log 104 is virtually split in half within the distance 143 by the vertical wedge 144.

In FIG. 6, as the log 104 continues along the vertical wedge 144, contact is made with the first leading edge 162 of the first horizontal wedge 146 and second leading edge 164 of second horizontal wedge 148. Upon contact with horizontal wedge assembly 145, the vertically split halves of log 104 begin to split into quarters. In FIG. 7, the lower quarter split log 104 has excellent clearance beneath the underside of the horizontal wedge assembly 145 and the top of the frame 110. Additional anti-locking clearance is provided by angling the log receiving platform 111 as shown by lower beam angle 158.

In FIG. 7, tilting the vertical wedge 144 by vertical wedge angle 156 away from the perpendicular to log receiving platform 111 of frame 110 enhances the vertical splitting force to occur at the base 176 of the vertical wedge 144 attached to frame 110. Vertical wedge angle 156 is up to five (5°) degrees from the vertical. Most preferably, vertical wedge angle 156 is up to four (4°) degrees from the vertical.

Also from FIG. 7, a chain receiving hook 282 is welded or otherwise secured to the top of the ram assembly 220. If a knotty log 104 stalls the ram assembly 220, the partially split log 104 is stuck to the wedge assembly 140 and is difficult to remove by hand tools.

LOADING RAMP

Figure 9:
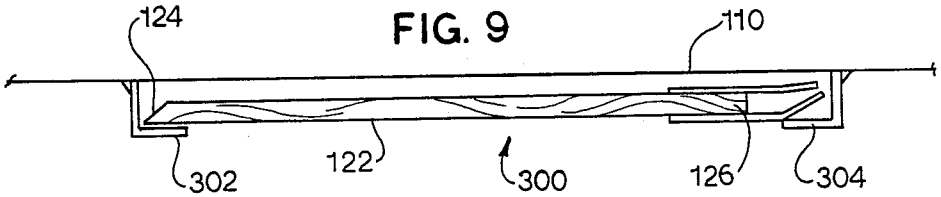
FIG. 9 illustrates a top view of the loading plank 122 in the stored position.

Referring now to FIG. 8 and FIG. 9, the loading ramp 122 has a beveled end 124 for contacting the ground and a latch end 126 for contacting the frame 110. Welded to the frame 110 but below the top edge of the I-beam is first angle arm 134 and and second angle arm 135 to serve as a mounting point for ramp 122. Either first angle arm 134 or second angle arm 135 form a loading mount which may receive latch end 126.

From FIG. 1, FIG. 2, FIG. 3 and FIG. 8, it can be seen that the loading ramp 122 may be secured to either side of the frame 110 as shown in FIG. 2 with angle iron 134 on first panel 116, and with angle iron 135 on second panel 118. The latch end 126 of loading ramp 122 has a double plate 138 secured thereto in order to wrap around loading mount and secure loading ramp 122 to the frame 110.

The storage of loading ramp 122 is thus shown in FIG. 8 and FIG. 9. The ramp storage assembly 300 with the U-shaped slots includes a first storage slot 302 and a second storage slot 304 oppositely disposed therefrom. First storage slot 302 and second storage slot 304 combine to receive the ramp 122 at each end thereof.

DESCRIPTION OF GAS THROTTLE LINKAGE SYSTEM

Figure 10:
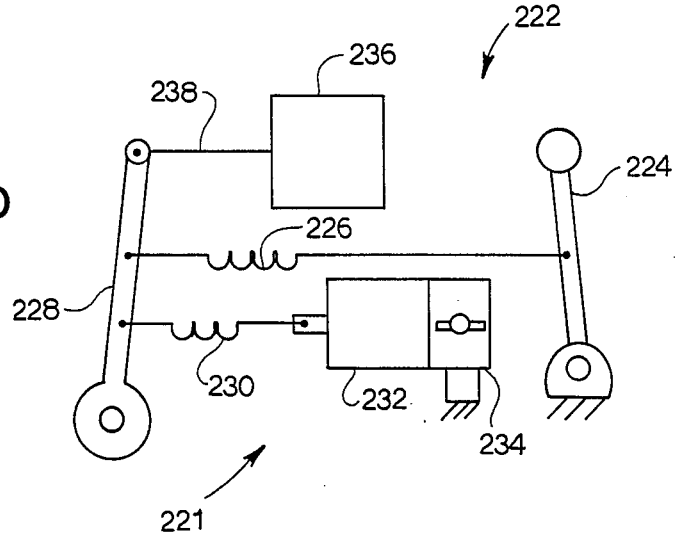
FIG. 10 illustrates a combined electrical-mechanical throttle control linkage 221 which speeds up the engine 222 when in the forward or reverse position with the center or neutral position idling the engine 222.

In FIG. 1, the ram assembly 220 includes gasoline engine 222. With the gasoline engine 222 there is a manual speed control 224. The manual speed control 224 is pivotally mounted on the engine 222. In FIG. 10 is linkage system 221. Connected to the manual speed control 224 is a control spring 226, which connects the manual speed control 224 to the governor arm 228. Also connected to the governor arm 228 is solenoid spring 230 which is connected to solenoid 232. The carburetor link 238 is also connected to the governor arm 228 and the carburetor 236. In this fashion, as engine 222 is operated with the manual speed control 224 or the solenoid 232, the speed of engine 222 can be controlled.

Figure 12:
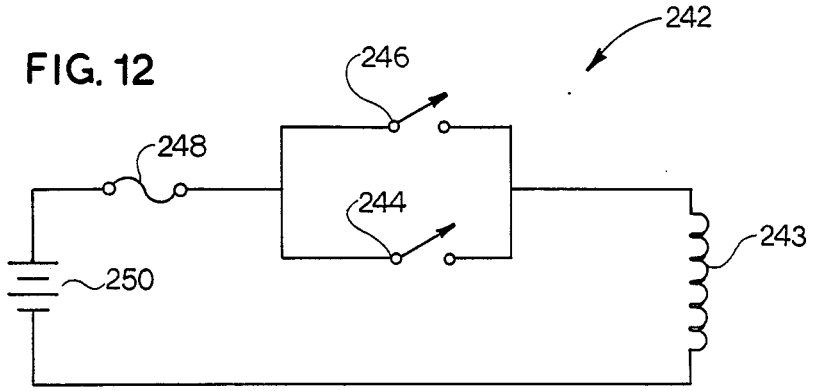
FIG. 12 depicts a schematic of the electrical circuit 242 which operates the speed of engine 222 through the electrical solenoid coil 243 as activated by the electrical switches 244 and 246.
Figure 11:
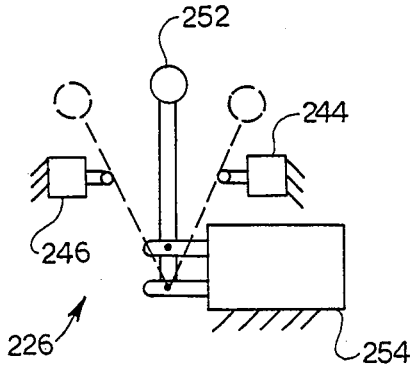
FIG. 11 illustrates a side view of the manually operated four (4) way hydraulic valve 226 with the electrical switches 244 and 246.

Referring now to FIG. 11 and FIG. 12, the electrical connections are shown. More specifically the solenoid coil 243 of solenoid 232 is depicted as being connected to a forward switch 244 and a retracting switch 246. A fuse 248 connects the switches 244 and 246 to battery 250. The negative terminal of battery 250 is also connected to the solenoid coil 243.

In FIG. 11 the hydraulic valve 254 has control lever 252 shown in a neutral position, contacting neither forward switch 244 or retracting switch 246. When lever 252 is in the forward position, it contacts forward switch 244. In the retracting position, the valve control lever 252 contacts retracting switch 246, and the ram assembly 220 retracts. In this fashion, the ram assembly 220 can be operated, while the speed of engine 222 can be adjusted as well.

In FIG. 1, the ram assembly 220 includes a first ram cylinder 262 and a second ram cylinder 260. The first ram cylinder 262 is sufficient for splitting smaller logs and provides the faster cycle time. Second ram cylinder 260 is used when first ram cylinder 262 has inadequate splitting force due to the size or knot characteristics of log 104. First ram cylinder 262 and, if additional force is required, second ram cylinder 260 propel the ram face 264 against the log 104. Centrally located in the ram face 264 is ram slot 266. In this fashion, the vertical wedge 144 can penetrate the ram slot 266 without contacting the ram face 264 and completely split the log 104.

TRAILER HITCH

Figure 14:
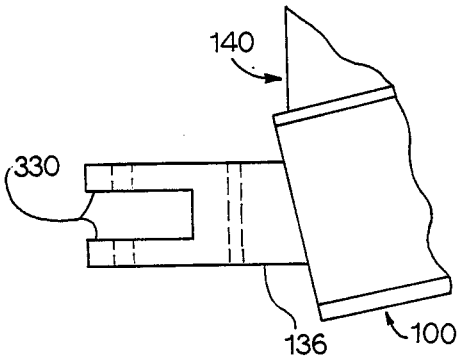
FIG. 14 is a depiction of the trailer hitch 136 as a wagon hitch.
Figure 13:
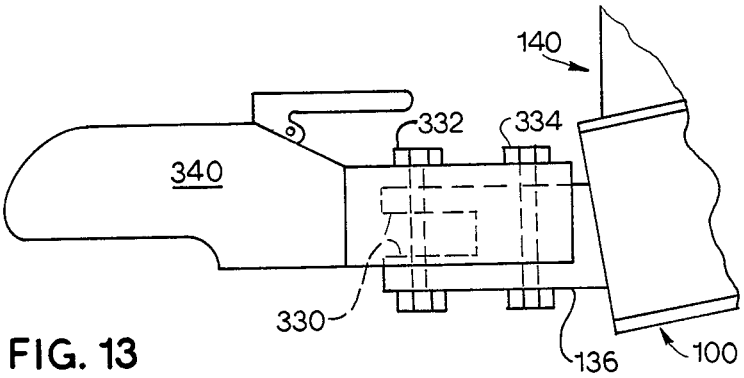
FIG. 13 is a depiction of the trailer hitch 136 converting from a wagon hitch to a ball hitch.

Referring now to FIG. 13 and FIG. 14, trailer hitch 136 is depicted. The trailer hitch 136 is U-shaped with bolt apertures therethrough. This type is preferred for farm or garden tractors and is common to farm implements for attachment to tractors. With this type of assembly, a standard hook up to a tractor or other farm implement can be made. The double slot form 330 is a U-shaped member securably mounted on the log splitter 100 adjacent to the wedge assembly 140.

The slot form 330 provides for a mounting mechanism to a tractor (not shown). In FIG. 13, a standard ball hitch 340 may be bolted with bolts 332 and 336 and convert the log splitter 100 to a capability of being towed by a standard ball hitch. In this fashion, the log splitter 100 may be towed by any convenient vehicle.

This application—taken as a whole with the specification, claims, and abstract,—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of the disclosure herein and solely because of the disclosure herein, certain modifications of the composition for removing nail polish disclosed herein can become clear to a person having ordinary skill in this art. Such modifications are clearly covered hereby.

What is claimed and sought to be secured by Letters Patent of the United States, is:

1. A powered log splitter for splitting a log having a housing, a splitting assembly mounted at a first end of said housing and a powered ram movably mounted at a second end of said housing, wherein:

a. said first end of said housing is oppositely disposed from said second end of said housing:

b. said splitting assembly splits said log with a single pass of said powered ram;

c. an electrical-mechanical solenoid actuated system is coupled to said powered ram;

d. said powered ram has a dual-cylinder mechanism;

e. said dual-cylinder mechanism includes a first hydraulic cylinder and a second hydraulic cylinder;

f. said first hydraulic cylinder moves said powered ram against said log;

g. a second cylinder actuating means activates said second cylinder as needed; and h. said powered ram has a ram face means capable of pushing said log completely past a leading edge of said wedge assembly.

2. The powered log splitter of claim 1 wherein said splitting assembly splits said log into four pieces with said single pass of said powered ram.

3. The powered log splitter of claim 2 wherein said electrical-mechanical solenoid actuated system has a fast forward position for moving said ram assembly toward said log and moving said log toward said wedge assembly, a idle position for providing a still position for said ram assembly, and a reverse fast position to retract said ram assembly from said log and said wedge assembly.

4. The powered log splitter of claim 3 wherein:

a. said housing includes a log receiving platform for supporting said log during splitting between said first end of said housing and said a second end of said housing;

b. a loading plank is removably fixed in a use position to a side of said log receiving platform for use in loading of said log; and c. a storage means for holding said loading plank on said powered log splitter in a stored position.

5. The powered log splitter of claim 4 wherein:

a. said first hydraulic cylinder is smaller than said second hydraulic cylinder;

b. said first hydraulic cylinder can handle said log and provide a fast cycle time for splitting said log;

c. said second hydraulic cylinder can provide force to split said log when said log is larger or knotty; and d. said ram face means includes a slot of sufficient depth to permit said log pushed completely past said leading edge of said wedge assembly and split said log into at least two pieces.

6. The powered log splitter of claim 5 wherein:

a. said wedge assembly includes a horizontal wedge assembly and a vertical wedge assembly;

b. said log contacts said horizontal wedge assembly after said log contacts said vertical wedge assembly in order to avoid a high force requirement for splitting said log;

c. said first end of said housing is angled downwardly relative to said second end of said housing;

d. said vertical wedge assembly is set back a distance on said first end to allow excess clearance for said log entering said vertical wedge assembly without interference from said log receiving platform;

e. said horizontal wedge assembly is set back a distance from said leading edge of said vertical wedge assembly; and f. said log has a greater clearance at a lower rear edge of said horizontal wedge assembly than at a leading edge of said horizontal wedge assembly to provide for splitting of said log into four pieces while minimizing sticking of said log on said powered log splitter.

7. The powered log splitter of claim 6 wherein:

a. said housing includes an I-beam having a central portion with a flat top side support said ram assembly in a slidable fashion and a flat base oppositely disposed from said flat top side support;

b. a first support plate is secured to said flat top side and said flat base on a first side of and substantially parallel to said central portion;

c. a second support plate is secured to said flat top side and said flat base on a second side of and substantially parallel to said central portion;

d. said first support plate and said second support plate add strength to said housing;

e. said first support plate provides a first ledge on a first edge of said top side;

f. said second support plate provides a second ledge on a second edge of said top side; and g. said first support plate and said second support combine to support said ram assembly on said first ledge and said second ledge.

8. The powered log splitter of claim 7 wherein:

a. said ram assembly includes a first ram cylinder and a second ram cylinder;

b. said second ram cylinder is larger than said first ram cylinder; and c. said second ram cylinder is usable on demand in conjunction with said first ram cylinder.

9. The powered log splitter of claim 8 wherein:

a. said loading mount includes a first angle bar mount on said first plate;

b. said loading mount includes a second angle bar mount on said second plate; and c. said loading plank has an optional beveled end for ground contact and latch end to receive said first angle bar mount and said second angle bar mount.

10. The log splitter of claim 9, wherein:

a. said ram face for contacting said log includes a slot for receiving said vertical wedge without contact therewith;

b. said ram mounting assembly includes a base plate slidable on said top side;

c. a first gripper is secured to a first spacer, said first spacer being secured to said base plate adjacent said first plate between said first gripper and said base plate; and d. a second gripper is secured to a second spacer, said second spacer being secured to said base plate adjacent said second plate between said second gripper and said base plate.

11. The log splitter of claim 10, wherein:

a. a log release assembly serves to release said log from said wedge;

b. said log release assembly includes a ram hook secured to said ram assembly, and a chain with a chain hook secured one end of said chain;

c. said chain hook is secured in said log and said chain is secured in said ram hook;

d. a chain bar is secured adjacent said log receiving platform; and e. said chain slidably engages said chain bar as said ram assembly withdraws from said log to release said log.

12. The log splitter of claim 11, wherein:

a. said wedge support is angled from said log receiving platform to form a lower beam angle;

b. a horizontal wedge angle of said horizontal wedge assembly is less than said lower beam angle; and c. said lower beam angle is in the range of 5 to 20 degrees.

13. The log splitter of claim 12, wherein:

a. said vertical wedge is angled at a vertical wedge angle from perpendicular to said log receiving platform;

b. a distance from said log receiving platform to said vertical wedge is up to about twelve centimeters;

c. said vertical wedge angle is up to five degrees from the vertical;

d. said latch end of said loading ramp has a double plate secured thereto in order to wrap around said loading mount and secure said loading ramp to said housing; and e. said loading ramp is stored in pair of U-shaped slots secured to said housing.

14. The log splitter of claim 13, wherein:

a. said ram assembly includes an engine;

b. a speed control for said engine is pivotally mounted on said engine;

c. a control spring is connected to said speed control and a governor arm;

d. a solenoid spring is connected to said governor arm and said solenoid spring;

e. a carburetor link is connected to said governor arm and said carburetor;

f. a solenoid coil of said solenoid is connected to a forward switch and a retracting switch;

g. said forward switch and said retracting switch are fuse connected to a positive terminal of a battery;

h. a negative terminal of said battery is connected to said solenoid coil; and i. a hydraulic, hand valve has a control lever movable to a neutral position to idle said engine, to a forward position in order to contact said forward switch and to a retract position in order to contact said retract switch.

15. The log splitter of claim 14, wherein:

a. said log splitter includes a trailer hitch;

b. said trailer hitch includes a U-shaped member with a bolt aperture therethrough;

c. said U-shaped member is attachable to a farm tractor; and d. said U-shaped member is capable of receiving a ball hitch.

16. A powered log splitter for splitting a log having a housing, a splitting assembly mounted at a first end of said housing and a powered ram movably mounted at a second end of said housing, wherein:

a. said first end of said housing is oppositely disposed from said second end of said housing;

b. said splitting assembly splits said log with a single pass of said powered ram;

c. an electrical-mechanical solenoid actuated system is coupled to said powered ram;

d. said powered ram has a dual-cylinder mechanism;

e. said dual-cylinder mechanism includes a first hydraulic cylinder and a second hydraulic cylinder;

f. said first hydraulic cylinder moves said powered ram against said log;

g. said said second cylinder is activated as needed;

h. said powered ram has a ram face means capable of pushing said log completely past a leading edge of said wedge assembly.

i. said splitting assembly splits said log into four pieces with said single pass of said powered ram;

j. said first hydraulic cylinder is smaller than said second hydraulic cylinder;

k. said first hydraulic cylinder provide a fast cycle time for splitting said log;

l. said second hydraulic cylinder can provide additional force to split said log when said log is larger or knotty; and m. said ram face means includes a slot of sufficient depth to permit said log pushed completely past said leading edge of said wedge assembly and split said log into at least two pieces.

17. The powered log splitter of claim 16 wherein:

a. said electrical-mechanical solenoid actuated system has a foward position for fast moving said ram assembly toward said log and moving said log toward said wedge assembly, a neutral position for providing a still position for said ram assembly and a fast reverse position to retract said ram assembly from said log and said wedge assembly;

b. said housing includes a log receiving platform for supporting said log during splitting between said first end of said housing and said a second end of said housing;

c. a loading plank is removably fixed in a use position to a side of said log receiving platform for use in loading of said log and left in said use position said log is being split;

d. a storage means for holding said loading plank on said powered log splitter in a stored position;

e. said wedge assembly includes a horizontal wedge assembly and a vertical wedge assembly;

f. said log contacts said horizontal wedge assembly after said log contacts said vertical wedge assembly in order to avoid a high force requirement for splitting said log;

g. said first end of said housing is angled downwardly relative to said second end of said housing;

h. said vertical wedge assembly is set back a distance on said first end to allow excess clearance for said log entering said vertical wedge assembly without interference;

i. said horizontal wedge assembly is set back a distance from said leading edge of said vertical wedge assembly;

j. said log has a greater clearance at a lower rear edge of said horizontal wedge assembly than at a leading edge of said horizontal wedge assembly to provide for splitting of said log into four pieces while minimizing sticking of said log on said powered log splitter;

k. said housing includes an I-beam having a central portion with a flat top side support said ram assembly in a slidable fashion and a flat base oppositely disposed from said flat top side support;

l. a first support plate secured to said flat top side and said flat base on a first side of and substantially parallel to said central portion;

m. a second support plate secured to said flat top side and said flat base on a second side of and substantially parallel to said central portion;

n. said first support plate and said second support plate add strength to said housing;

o. said first support plate provides a first ledge on a first edge of said top side;

p. said second support plate provides a second ledge on a second edge of said top side;

q. said first ledge and said second ledge combine to support said ram assembly;

r. said ram assembly includes a first ram cylinder and a second ram cylinder;

s. said second ram cylinder is larger than said first ram cylinder;

t. said second ram cylinder is usable in conjunction with said first ram cylinder;

u. said loading mount includes a first angle bar mount on said first plate;

v. said loading mount includes a second angle bar mount on said second plate; and w. said loading plank has an optional beveled end for ground contact and latch end to receive said first angle bar mount and said second angle bar mount.

18. The powered log splitter of claim 17 wherein:

a. said ram face for contacting said log includes a slot for receiving said vertical wedge without contact therewith;
b. said ram mounting assembly includes a base plate slidable on said top side;
c. a first gripper is secured to a first spacer, said first spacer being secured to said base plate adjacent said first plate between said first gripper and said base plate;
d. a second gripper is secured to a second spacer, said second spacer being secured to said base plate adjacent said second plate between said second gripper and said base plate;
e. a log release assembly serves to release said log from said wedge;
f. said log release assembly includes a ram hook secured to said ram assembly, and a chain with a chain hook secured one end of said chain;
g. said log hook is secured in said log and said chain is secured in said chain hook;
h. said wedge support is angled from said log receiving platform to form a lower beam angle;
i. a horizontal wedge angle of said horizontal wedge assembly is less than said lower beam angle;
j. said lower beam angle is in the range of 5 to 20 degrees;
k. said vertical wedge is angled at a vertical wedge angle from perpendicular to said log receiving platform;
l. a distance from said log receiving platform to said vertical wedge is up to about twelve centimeters;
m. said vertical wedge angle is up to five degrees from the vertical;
n. said latch end of said loading ramp has a double plate secured thereto in order to wrap around said loading mount and secure said loading ramp to said housing; and
o. said loading ramp is stored in pair of U-shaped slots secured to said housing.

19. The log splitter of claim 18, wherein:
a. said ram assembly includes a gasoline engine;
b. a speed control for said engine is pivotally mounted on said engine;
c. a control spring is connected to said speed control and a governor arm;
d. a solenoid spring is connected to said governor arm and said solenoid spring;
e. a carburetor link is connected to said governor arm and said carburetor;
f. a solenoid coil of said solenoid is connected to a forward switch and a retracting switch;
g. said forward switch and said retracting switch are fuse connected to a positive terminal of a battery;
h. a negative terminal of said battery is connected to said solenoid coil;
i. a hydraulic valve has a control lever movable to a neutral position, to said forward switch and said retract switch;
j. said log splitter includes a trailer hitch;
k. said trailer hitch includes a U-shaped member with a bolt aperture therethrough;
l. said U-shaped member is attachable to a farm tractor; and
m. said U-shaped member is capable of receiving a ball hitch.

20. A method for splitting a log on a power logsplitter into four pieces, wherein said method comprises:
a. supporting said log on a log receiving platform;
b. driving said log toward a splitting assembly, and splitting assembly being supported on a downward angle from said log receiving platform to avoid jumping of said log on said logsplitter;
c. contacting a face of said log with a vertical wedge of said splitting assembly in order to begin a vertical splitting of said log and;
d. contacting said face with a pair of horizontal wedges of said splitting assembly in order to begin a horizontal splitting of said log to form four pieces.

* * * * *